United States Patent [19]

von Schuckmann

[11] Patent Number: 4,967,937

[45] Date of Patent: Nov. 6, 1990

[54] DISPENSER FOR THE PORTIONED DISPENSING OF PASTY COMPOSITIONS

[76] Inventor: Alfred von Schuckmann, Kervenkonk 63, 4178 Kevelaer 2, Fed. Rep. of Germany

[21] Appl. No.: 361,026

[22] Filed: Jun. 2, 1989

[30] Foreign Application Priority Data

Jun. 4, 1988 [DE] Fed. Rep. of Germany ..... 3819042

[51] Int. Cl.[5] ..... B67D 5/42

[52] U.S. Cl. ..... 222/136; 222/257; 222/320

[58] Field of Search ..... 222/135–136, 222/145, 153, 256–257, 259, 320, 340, 387, 383, 391, 556

[56] References Cited

U.S. PATENT DOCUMENTS

| | | | |
|---|---|---|---|
| 3,268,123 | 8/1966 | Spatz | 222/400.5 |
| 4,629,097 | 12/1986 | Moore | 222/153 |
| 4,691,847 | 9/1987 | Ford et al. | 222/259 |
| 4,793,522 | 12/1988 | Corsette | 222/257 |
| 4,821,926 | 4/1989 | Battegazzore | 222/209 |
| 4,826,044 | 5/1989 | Volfson | 222/94 |
| 4,848,595 | 7/1989 | Foster et al. | 222/153 |
| 4,856,679 | 8/1989 | Czech | 222/136 |

FOREIGN PATENT DOCUMENTS 3104726 8/1982 Fed. Rep. of Germany .

*Primary Examiner*—Michael S. Huppert
*Attorney, Agent, or Firm*—Martin A. Farber

[57] ABSTRACT

A dispenser for the portioned dispensing of its contents, in particular a pasty composition, has a piston which is displaced stepwise in the emptying direction, an actuating handle which is displaced against spring force, and an outlet opening of the dispensing tube, which outlet opening can be closed by a closure part formed on the actuating handle. Also, upon a return movement of the actuating handle (6), the closure part (10) closes the outlet opening (11) by form-locked application, and pulls the dispensing tube (7) out of its dispensing position into a position of rest.

7 Claims, 5 Drawing Sheets

DISPENSER FOR THE PORTIONED DISPENSING OF PASTY COMPOSITIONS

FIELD AND BACKGROUND OF THE INVENTION

The present invention relates to a dispenser for a portioned dispensing of its contents, in particular a pasty composition, the dispenser having a piston which can be displaced stepwise in the emptying direction, an actuating handle which is displaceable against spring force, and an outlet opening in the dispensing tube, and wherein the outlet opening is adapted to be closed by means of a closure part formed on the actuating handle.

Such dispensers are already known in numerous versions. They serve, in particular, as toothpaste dispensers but also, for instance, as dispensers for mayonnaise, ketchup or the like.

The dispensing tube of such a dispenser must be closed again after its use in order to prevent the dispenser and its contents from becoming unusable, in particular due to drying out. Numerous possible solutions are already known. There is first of all known, for instance from U.S. Pat. No. 3,217,933, an automatic closure which closes the dispensing opening upon the release of the actuating handle. In the device of that patent, a slide, which closes the cross section of the dispensing tube immediately in front of the dispensing opening, is opened upon depressing a handle. Upon the release of the handle, the slide is automatically inserted again, by spring force, into the dispensing tube. It is furthermore known from U.S. Pat. No. 3,268,123 to provide in a dispenser, which has a follow-up piston, a closure plug which is disposed inside the dispensing tube and moves downward out of the way upon actuation.

It is known from Federal Republic of Germany OS No. 31 04 726 to develop a closure cap in one piece with the actuating handle. Upon the swinging of the actuating handle, the closure cap is swung away in upward direction from the opening of the fixed dispensing tube. The same principle is utilized also in U.S. Pat. No. 4,691,847.

SUMMARY OF THE INVENTION

It is the object of the present invention to develop a dispenser of the type described above and, in particular, for example, a dispenser such as known from Federal Republic of Germany OS No. 31 04 726 in a manner which makes it more advantageous in use.

This object is achieved first of all, in particular, in a device wherein, upon a return movement of an actuating handle (6), a closure part (10) closes an outlet opening (11) by form-locked application, and carries a dispensing tube (7) out of a dispensing position and into a position of rest.

In accordance with the invention, a dispenser for the portioned dispensing of its contents, in particular a pasty composition, is disclosed. The dispenser has a piston which can be displaced stepwise in the emptying direction and an actuating handle which can be displaced against spring force. The outlet opening of the dispensing tube can be closed by means of a closure part formed on the actuating handle. Upon a return movement of the actuating handle, after the latter has been depressed for the dispensing of a portion of the pasty composition, the closure part comes into engagement in form-locked and closing manner with the outlet opening of the dispensing tube.

During a further return movement of the actuating handle, the dispensing tube is raised or carried along from the dispensing position into the position of rest by the closure part which is applied in form-locked and closing manner. The raising takes place against the weight of the dispensing tube and of the pasty composition raised by the dispensing tube. Complete tightness of the closure is very substantially assisted by this.

In order further to increase the tightness of the closure, the invention provides a circumferential groove forming a sealing lip in the outer wall of the dispensing tube, immediately in front of the outlet opening. It is also advantageous to provide, on the side of the closure part facing the outlet opening of the dispensing tube, a raised closure base which extends, in closed condition, into the inside of the dispensing tube in the region of a sealing lip. The closure base forms, so to speak, a plug of small height. In order to make it possible for the closure part to come into form-locked engagement with the dispensing tube in the region of the outlet opening, it is proposed that the outlet cross section of the dispensing opening be an inclined surface, in the manner that a lower edge section of the outlet opening is set back with respect to an upper edge section of the outlet opening.

In a further aspect of the invention, the outlet opening could also be developed with a curved surface, in which case an edge section of the outlet opening provides form-locked application of the closure part. A pump chamber is furthermore developed in the dispenser, which pump chamber has a cylindrical region which is formed by a wall attached to the housing. In the cylindrical region of the pump chamber, the dispensing tube is guided for axial movement. In the lower end wall of the pump chamber there is provided a tube extension which extends into the storage space. Due to this tube extension, an annular space results in the storage space, which annular space is suitable for the storing of a composition of a second type, such as a composition of a second color in the case of a toothpaste dispenser.

On the pump-chamber side, the tube extension can be covered by a closure cover which is mounted in the tube extension for axial movement limited by stops. The mounting is realized in detail by holding and guide webs which extend within the tube extension and are shaped in the manner of barbs at their ends. With respect to the annular space developed on the storage-space side for the second composition, the pump chamber has separate passage openings, while the first composition can be conveyed into the pump chamber through the extension, which can be closed by a cover. The passage openings for the second composition can be covered only partially by the closure cover which can cover the tube extension in completely closing manner. Even when the tube extension is closed by the closure cover, the passage openings for the second composition are partially open. Thus, for the second composition, there exists a non-closable permanent connection to the pump chamber.

As a further feature, it is proposed to have the passage openings for the second composition discharge into grooves which are developed in the bottom section of the pump chamber, which bottom section as a whole extends in the shape of a funnel. In closed condition, the grooves are partially covered by a closure cover. On its bottom side, the closure cover is shaped correspondingly in part as a funnel, but it has no projections corresponding to the grooves so that, in closed condition, it merely forms an upper limitation of the grooves for those regions of the grooves which it covers. The grooves extend in radial direction. This development has the advantage that, upon the closing movement which takes place due to the pumping process and with the closed position of the closure cover, the second composition is partially pressed merely into the grooves. However, no complete separation or areal spreading of the strands of the second composition which flow through the grooves can take place.

Upon a return movement of the actuating handle, during which, as already stated above, the dispensing tube is carried along by means of the closure part which closes the outlet opening, the closure cover is lifted off from the outlet opening of the tube extension on the pump-chamber side, and pasty composition is drawn into the pump chamber through the tube extension as well as through the separate passage openings for the second composition. The pasty composition of the first type flows through the tube extension and, being deflected there, past the edge of the closure cover, while the pasty composition of the second type flows in this region practically only in the grooves provided.

In the raised condition of the dispensing tube, i.e. in the position of rest of the dispenser, the closure cover for the tube extension remains in its raised position. Therefore, in condition of rest, there is present a constant moisture connection between the pump chamber and storage space not only for the pasty composition of the second type but also for the pasty composition of the first type. With this dispenser, it has been found to be a surprising advantage that, despite the continuously open passage openings into the pump chamber for the second composition, any blocking of the return travel of the follow-up piston can be dispensed with since the closure cover keeps the connection between pump chamber and storage space sufficiently tight, even though not completely so.

BRIEF DESCRIPTION OF THE DRAWINGS

The invention is explained in further detail below with reference to the accompanying drawings, which, however, show merely one embodiment and in which.

DETAILED DESCRIPTION OF THE PREFERRED EMBODIMENT

Figure 1:
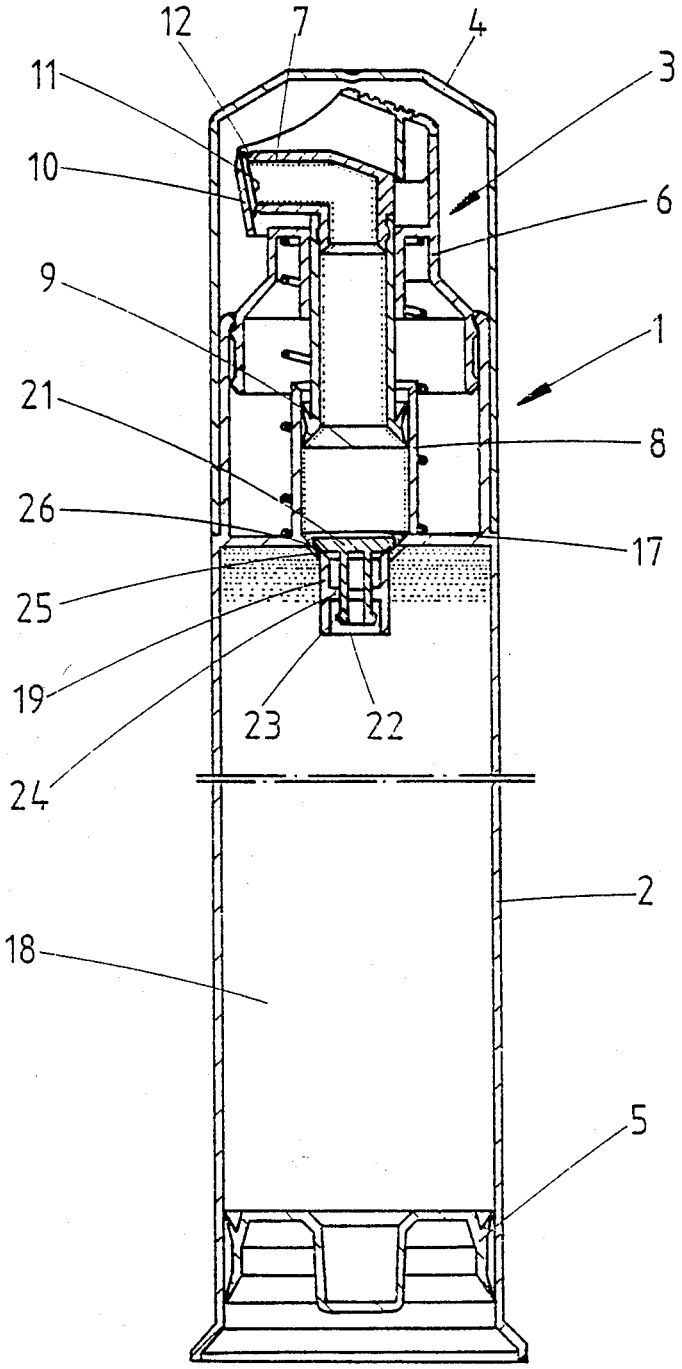
FIG. 1 is a cross-sectional showing of a dispenser in accordance with the invention, seen in unactuated condition.

There is shown and described a dispenser for the portioned dispensing of a pasty composition, generally designated 1, which has a known cylindrical housing 2 and in which, according to FIG. 1, there is a dispenser head 3 covered by a cap 4. A piston 5, which can be displaced stepwise in the emptying direction, is arranged in the cylindrical housing 2. The dispenser head 3 has an actuating handle 6 and a dispensing tube 7. The dispensing tube 7 is axially displaceable in the actuating handle 6 and guided in a cylindrical region 8 of the pump chamber 9, which region is attached to the housing.

A closure part 10 is formed on the actuating handle 6, this closure part being adapted to close the outlet opening 11 of the dispensing tube 7. Upon a return movement of the actuating handle, i.e. upon a movement from the position according to FIG. 3 into a position according to FIG. 4 and further into a position according to FIG. 5, the closure part 10 comes into form-locked and closing application against and within the outlet opening 11 of the dispensing tube 7. By this application and the additional return movement of the actuating handle 6, the dispensing tube 7 is raised or pulled back from a dispensing position according to FIG. 3 into a position of rest according to FIG. 1 or FIG. 5. Due to the necessary simultaneous movement of the pasty composition, the piston 5 is thereby raised at the same time.

Near the outlet opening 11, the dispensing tube 7 has an outer circumferential groove 12 which forms a sealing lip 13. In the closed condition according to FIG. 1 or FIG. 5, the sealing lip 13 is applied in sealing fashion against the inside of the closure part 10. Due to the fact that the dispensing tube 7 is carried along—in form-locked cooperation—from a dispensing position according to FIG. 3 into a position of rest according to FIG. 5 or FIG. 1, there results a very tight seat of the closure part 10 against the outlet opening 11, especially since the weight which must be lifted upon the return movement via the closure part 10 is relatively great. The weight comprises the dispensing tube 7 and, in particular, the pasty composition which is raised simultaneously with same.

Figure 2:
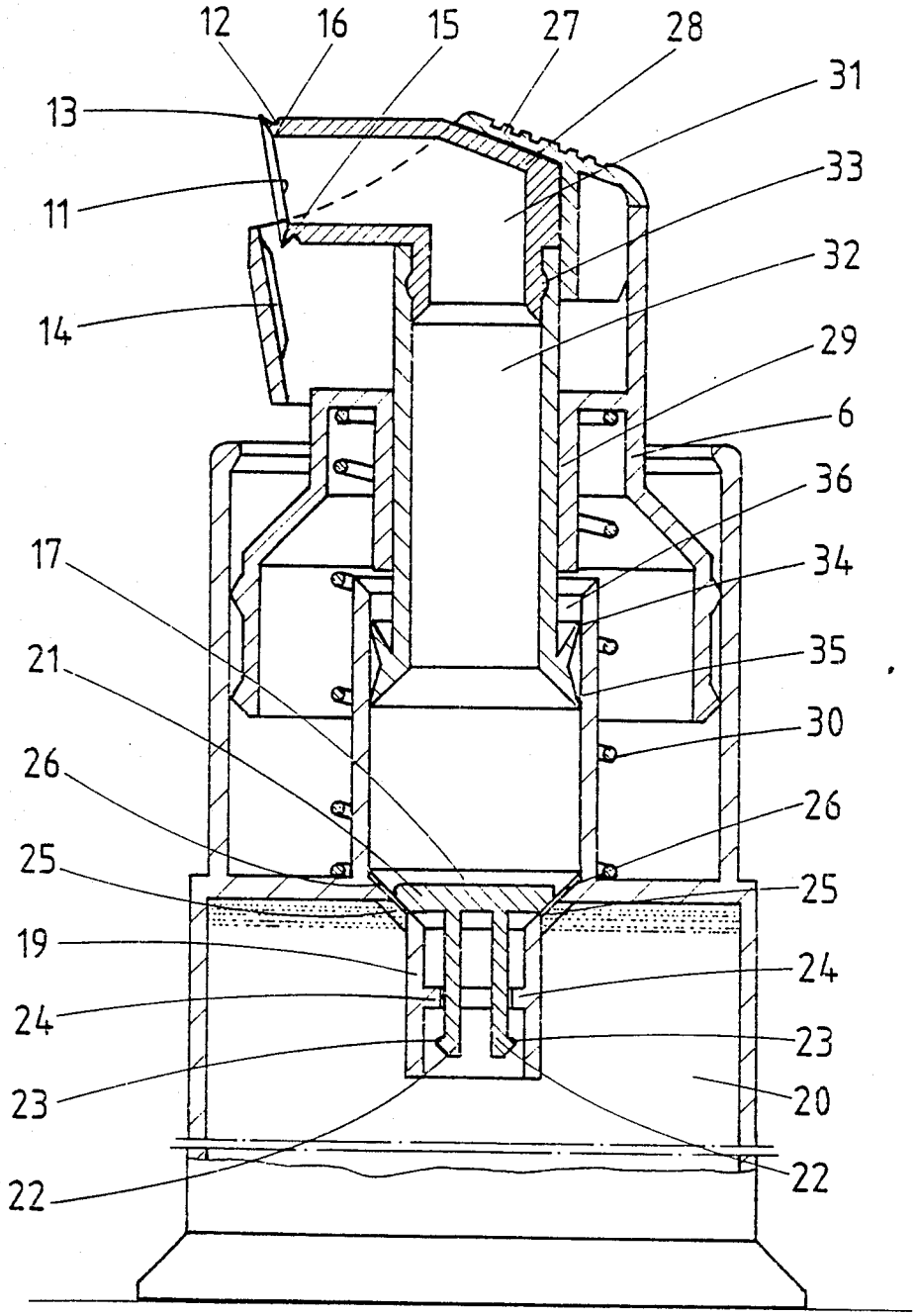
FIG. 2 is a cross-sectional showing according to FIG. 1, with the top part of the dispenser shown on a larger scale and the dispensing tube being open but not yet depressed.
Figure 3:
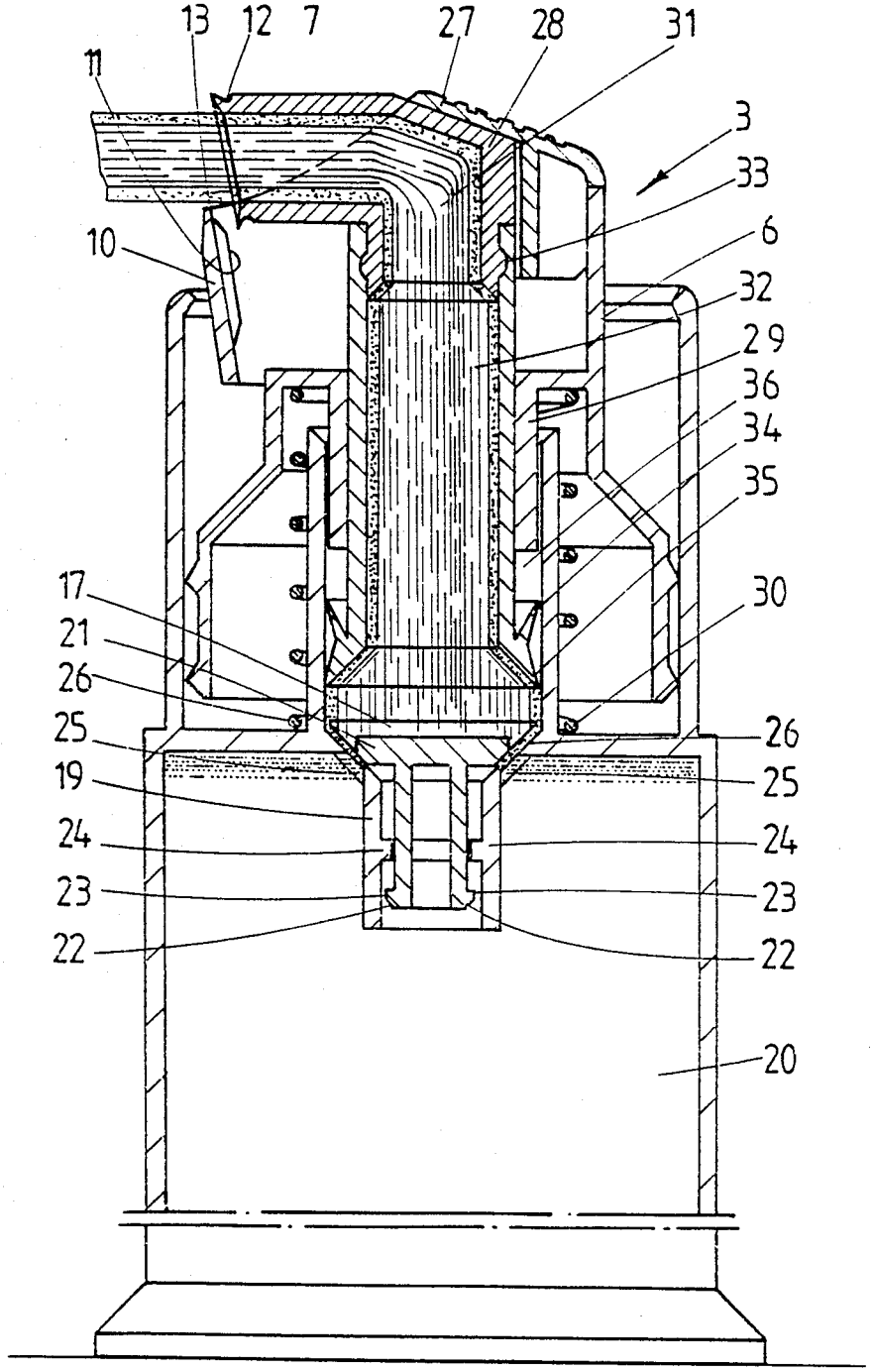
FIG. 3 is a showing according to FIG. 2, with the dispensing tube depressed and an emerging strand of composition.

In order further to improve the sealing seat, a raised closure base 14 is formed on the inside of the closure part 11, as can be noted in particular, for instance, from FIGS. 2 and 3. The closure base extends in closed condition in the region of the sealing lip 13 and into the inside of the dispensing tube 7, although only by a small amount.

The outlet cross section of the outlet opening 11 of the dispensing tube 7 is developed as inclined surface in the manner that a lower edge section 15 of the outlet opening 11 is set back with respect to an upper edge section 16 of the outlet opening. The closure part 10 is developed correspondingly inclined, which results in the form-locked engagement in closed condition.

The pump chamber 9, which is formed in its upper region by the dispensing tube 7 and is also closed by the closure part 10 in closed condition, has in its bottom region 17 a tube extension 19 which extends from the pump chamber 9 into the storage space 18 in order to form an annular space 20 for a composition of a second type, for instance a colored composition in the case of toothpaste.

The tube extension 19 is closed towards the pump chamber 9 by a closure cover 21 which has webs 22 formed on it which extend towards the storage space 18. The webs 21 are provided at their ends with outward extending barb-shaped projections 23 which, upon axial movement of the closure cover 21, come against stops 24 which are developed on the inside of the tube extension 19. The closure cover 21 is thereby axially displaceable, limited by stops.

Separate passage openings 25 are developed from the annular space 20 into the pump chamber 9. In closed condition, these passage openings 25 are merely partially covered by the closure cover 21, as can be noted, for instance, from FIGS. 2 and 3.

The passage openings 25 for passage of the second composition into the pump chamber 9 discharge into grooves 26 which are developed radially in the funnel-shaped bottom region 17 of the pump chamber 9. Upon actuation of the dispenser, the pasty composition of the second color travels through these grooves towards the cylindrical wall region 8 of the pump chamber 9 and then along the inner surface of the dispensing tube 7 towards the outlet opening 11. Upon the pumping, and due to the flowing past of the composition of the first type—through the tube extension 19 and along the bottom side of the closure plate 21—the composition of the second type is, in part, even literally pressed into the grooves 26. The dispenser results in a surprisingly clear, undiluted formation of stripes. Due to the fact that the second composition is guided via grooves in the bottom section 17 of the pump chamber 9, no impairment of the strands of the second composition in the grooves 26 results upon movement of the closure plate 21 between a closed position and open position, even though the closure plate 21 partially covers the grooves.

Upon actuation of the dispenser 1, the actuating handle 6 is first of all, as shown in FIG. 2, moved downward together with the closure part 10 formed thereon, by means of pressure on the actuating handle 6. The dispensing tube 7 remains in this case practically stationary since downward movement is practically impossible or possible only to a very slight extent due to the complete filling with pasty composition and the closure plate 21. After complete opening of the outlet opening 11, a covering region 27 of the actuating handle 6 comes against the dispensing tube 7, namely against a deflection region 28. When the actuating button 6 is pressed down further, as shown in FIG. 3, the dispensing tube 7, which is guided for axial movement in the cylindrical part 29 of the actuating handle 6 and in the cylindrical part 8 of the pump chamber 9, which part is fixed to the housing, is pressed down and the corresponding portion of pasty composition is dispensed at the outlet opening 11. For clarification, the pasty compositions of the first and second type are shown separately in FIG. 3 in the region of the dispensing tube 7 and of the upper part of the annular space 20.

Figure 4:
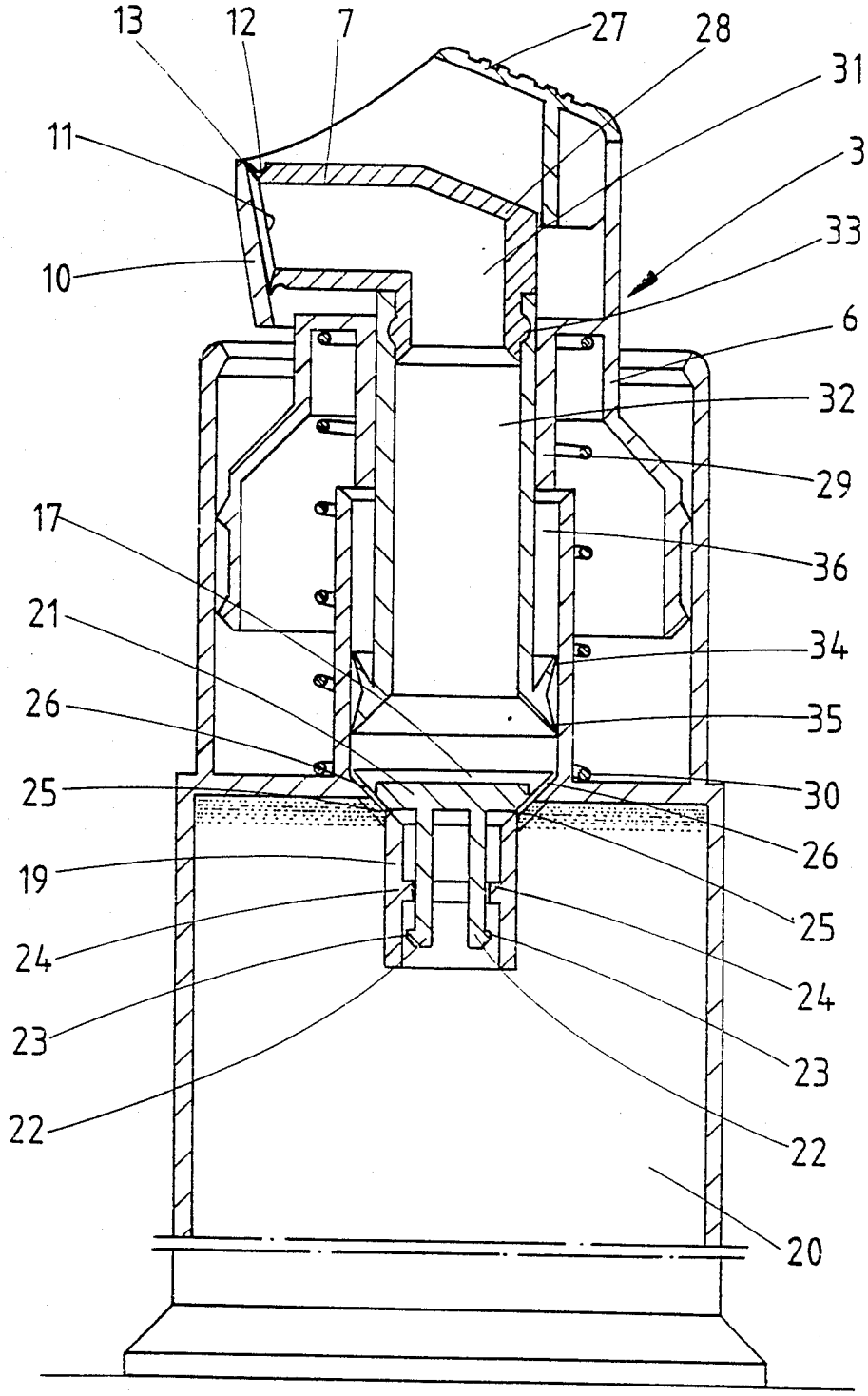
FIG. 4 is a showing according to FIG. 3, with the dispensing tube again closed but depressed.
Figure 5:
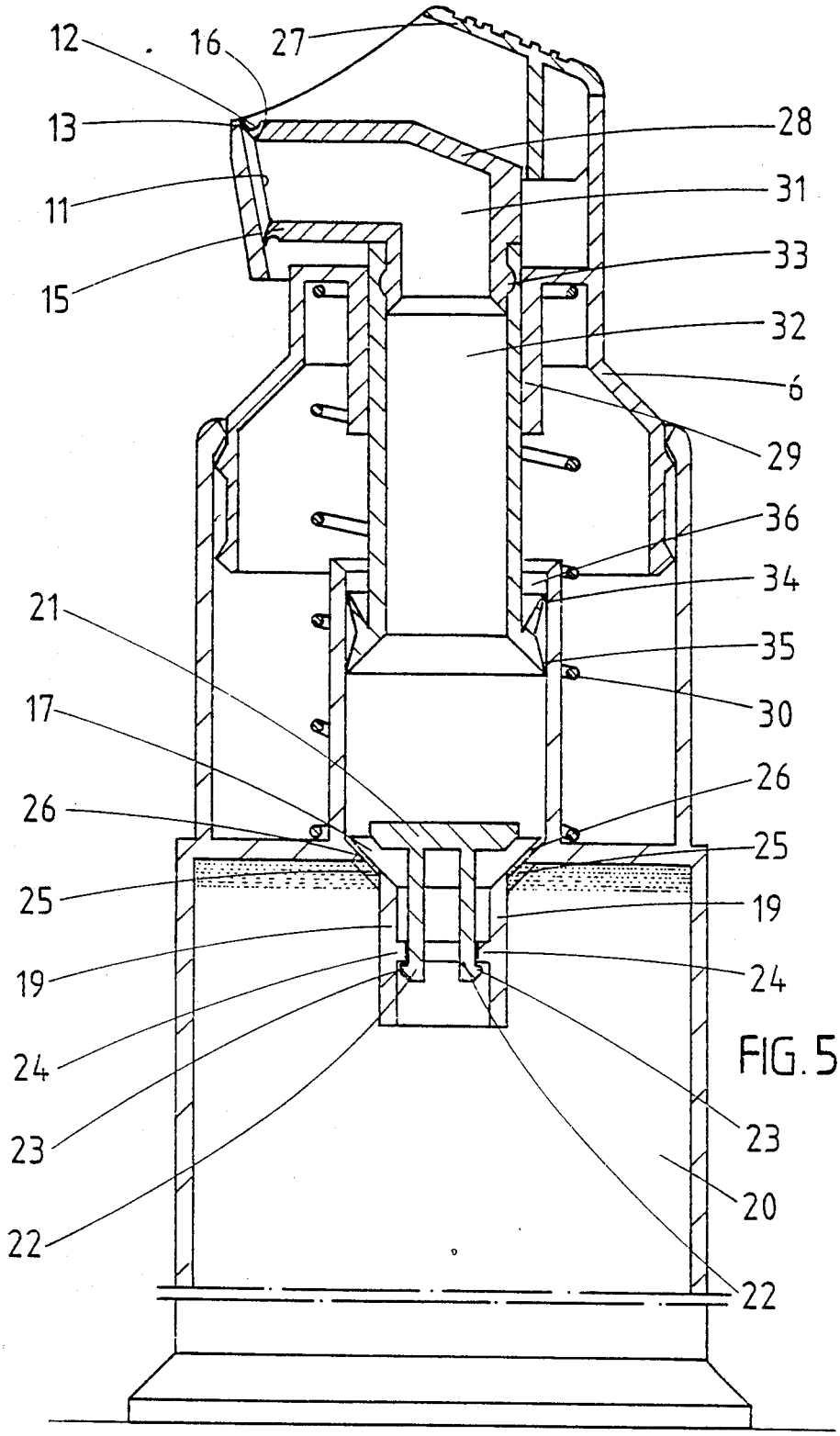
FIG. 5 is a showing according to FIG. 4, with the dispensing tube raised.

When the actuating handle 6 is released, it moves, together with the closure part 10 formed thereon, due to the spring force exerted by a spring 30, from the dispensing position according to FIG. 3 back into its position of rest. The closure part 10 in this case comes, as shown in FIG. 4, into form-locked and closing application in the region of the outlet opening 11, initially with the dispensing tube 7 still depressed. Upon further return movement of the actuating handle 6 into the position of rest, the dispensing tube 7 is now pulled along, together with the pasty composition in the pump chamber 9 and the storage space 18. Due to the pasty composition which flows into the pump chamber 9, the closure plate 21 is raised. In condition of rest, the closure plate 21 is therefore usually opened, see FIG. 5, contrary to the showing of FIG. 1. In this way, there is advantageously created a continuous moisture connection between pump chamber 9 and storage space 18.

The dispensing tube consists, in detail, of two parts 31 and 32 which are clipped or clamped together at 33. Sealing lips 34 and 35 are formed on the lower end region of the part 32 at a radial distance from the outer wall of the part 32, the sealing lips being applied in sealing fashion against the inner surface of the cylindrical part 8 and assuring, at the same time, guidance of the dispensing tube 7. The radial distance of the sealing lips 34 and 35 from the cylindrical wall of the part 32, in which connection the part 8 is developed with a corresponding inside diameter, results in an annular space 36 into which the cylindrical part 29 of the actuating handle 6 can advantageously enter in depressed condition, see for instance FIG. 3. The actuating handle 6 is guided in the head part 37 of the dispenser 1. Due to the fact that the cylindrical part 29 which, as described above, has entered in the dispensing position into the annular space 36, there results a very dependable holding of the dispenser head in the dispensing position.

I claim:

1. A dispenser having a storage chamber for dispensing a portion of material contained in the chamber, the material being a pasty composition, the dispenser comprising a piston which is displaceable stepwise in the chamber in a direction for emptying the dispenser, a spring-loaded, displaceable actuating handle;

a dispensing tube and an outlet opening in the dispensing tube; and wherein, upon actuation of the handle, the handle urges the dispensing tube to a dispensing position for receiving the material from the chamber during a dispensing of the material;

the dispenser further comprises a closure part formed on the actuating handle for closing the outlet opening of the dispensing tube; and upon a return movement of the actuating handle, the closure part closes the outlet opening by form-locked closure, and contacts the dispensing tube to urge the dispensing tube out of the dispensing position into a position of rest.

2. A dispenser, in particular according to claim 1, wherein an outlet cross section of said outlet opening has an inclined surface, a lower edge section of the outlet opening being set back with respect to an upper edge section of the outlet opening.

3. A dispenser according to claim 1, further comprising a pump chamber having a closeable tubular section which extends from the pump chamber into said storage chamber for the formation of an annular space in an entry of the storage chamber, said storage chamber serving to hold a first composition of the material and said annular space serving to hold a second composition of the material, and wherein said tubular section is provided with separate passage openings for transport of the second composition from said annular space into said pump chamber, the tubular section having a closure cover for partially covering the passage openings.

4. A dispenser according to claim 3, wherein said tubular section includes grooves, and the passage openings discharge into the grooves, and the grooves are partially covered by the closure cover during a closed condition of said closure cover.

5. A dispenser according to claim 1, further comprising a housing, there being a cylindrical part of said pump chamber attached to the housing, and wherein said dispensing tube acts as a pump piston upon movement by said handle, and is guided in the cylindrical part of the pump chamber.

6. A dispenser having a storage chamber for dispensing a portion of material contained in the chamber, the material being a pasty composition, the dispenser comprising a piston which is displaceable stepwise in the chamber in a direction for emptying the dispenser, a spring-loaded, displaceable actuating handle;

a dispensing tube and an outlet opening in the dispensing tube; and wherein, upon actuation of the handle, the handle urges the dispensing tube to a dispensing position for receiving the material from the chamber during a dispensing of the material;

the dispenser further comprising a closure part formed on the actuating handle for closing the outlet opening of the dispensing tube;

upon a return movement of the actuating handle, the closure part closes the outlet opening by form-locked closure, and contacts the dispensing tube to urge the dispensing tube out of the dispensing position into a position of rest; and said outlet opening is provided with a sealing lip formed by a circumferential groove in a wall of the dispensing tube.

7. A dispenser according to claim 6, wherein on a side of said closure part which faces said outlet opening there is provided a raised closure base which, in a closed condition of the dispenser, extends into a region of the sealing lip.

* * * * *